US008297726B2

(12) United States Patent
Ramm et al.

(10) Patent No.: US 8,297,726 B2
(45) Date of Patent: Oct. 30, 2012

(54) MECHANISM FOR MOVING SHELVES OF A REFRIGERATION APPLIANCE AND REFRIGERATION APPLIANCE

(75) Inventors: Axel Júlio Ramm, Joinville SC (BR); Luiz Afrânio Alves Ferreira, Joinville SC (BR); Lauro Ferando Souza Ignácui Júnior, Joinville SC (BR)

(73) Assignee: Whirlpool S.A., Sao Paulo (BR)

( * ) Notice: Subject to any disclaimer, the term of this patent is extended or adjusted under 35 U.S.C. 154(b) by 577 days.

(21) Appl. No.: 12/498,218

(22) Filed: Jul. 6, 2009

(65) Prior Publication Data

US 2010/0066227 A1 Mar. 18, 2010

(30) Foreign Application Priority Data

Jul. 7, 2008 (BR) ..... 0802420

(51) Int. Cl.
*A47B 96/04* (2006.01)

(52) U.S. Cl. ..... 312/408; 312/410

(58) Field of Classification Search ..... 312/408, 312/410, 325; 108/136, 145–147, 147.11, 108/147.16, 147.22, 106, 108; 16/54
See application file for complete search history.

(56) References Cited

U.S. PATENT DOCUMENTS

| | | | | |
|---|---|---|---|---|
| 2,284,339 | A * | 5/1942 | Nauert | 312/323 |
| 2,998,290 | A * | 8/1961 | Sharpe | 312/303 |
| 4,528,825 | A * | 7/1985 | Khan | 62/441 |
| 5,462,347 | A * | 10/1995 | Vogelgesang et al. | 312/247 |
| 5,971,514 | A * | 10/1999 | Hayakawa | 312/319.2 |
| 6,971,996 | B2 * | 12/2005 | Houser | 602/16 |
| 7,101,002 | B2 * | 9/2006 | Bienick | 312/408 |
| 7,264,322 | B2 * | 9/2007 | Dallman et al. | 312/408 |
| 7,316,326 | B2 * | 1/2008 | Kim et al. | 211/90.03 |
| 7,581,796 | B2 * | 9/2009 | Jeong et al. | 312/402 |
| 7,607,744 | B2 * | 10/2009 | Casoli et al. | 312/408 |
| 7,618,103 | B2 * | 11/2009 | Kim | 312/408 |
| 7,740,332 | B2 * | 6/2010 | Bassi | 312/408 |
| 7,950,756 | B2 * | 5/2011 | Collins et al. | 312/408 |
| 2003/0173882 | A1 * | 9/2003 | Koons | 312/404 |
| 2004/0195945 | A1 * | 10/2004 | Farber et al. | 312/408 |
| 2011/0031863 | A1 * | 2/2011 | Benitsch et al. | 312/408 |

FOREIGN PATENT DOCUMENTS

JP 8035765 A 2/1996

(Continued)

OTHER PUBLICATIONS

U.S. Appl. No. 12/498,200, filed Jul. 6, 2009, by Axel Julio Ramm.

*Primary Examiner* — Hanh V Tran
(74) *Attorney, Agent, or Firm* — Woodcock Washburn LLP

(57) ABSTRACT

A mechanism, and refrigeration appliance containing a mechanism, for providing displacement of a shelf of a refrigeration appliance, which has at least one refrigeratable cabinet with a base and two side walls substantially perpendicular to the base. The mechanism has at least one supporting device associated to the side wall of the refrigeratable cabinet by a side bar having a longitudinal portion that is substantially parallel to the base. The association between the supporting device and the side bar is able to provide mechanical support to the shelf. The mechanism also comprises a pivoting arm provided with at least one first end which is connected articulatedly to the shelf and a second end connected articulatedly to the supporting device, which associates the shelf to the supporting device. The pivoting arm is able to move angularly so as to allow the displacement of the shelf in relation to the supporting device.

19 Claims, 7 Drawing Sheets

FOREIGN PATENT DOCUMENTS

| | | | |
|---|---|---|---|
| JP | 2003176977 | A | 6/2003 |
| KR | 100756887 | B1 | 9/2007 |
| WO | 2005/001352 | A1 | 1/2005 |
| WO | 2006/122913 | A1 | 11/2006 |

* cited by examiner

MECHANISM FOR MOVING SHELVES OF A REFRIGERATION APPLIANCE AND REFRIGERATION APPLIANCE

CROSS REFERENCE TO RELATED APPLICATION

This application claims priority to Brazilian Application No. PI0802420-0, filed Jul. 7, 2008, the entire disclosure of which is incorporated herein by reference.

TECHNICAL FIELD

The present invention refers to a mechanism for moving shelves in a refrigeration appliance. More particularly, the present invention relates to a mechanism that is able to provide a displacement of a shelf of a refrigeration appliance, so as to allow better usage of the internal space of its cabinet in accordance to the user's needs.

The present invention also refers to a refrigeration appliance that is able to provide better usage of the internal space of its cabinet in accordance to the user's needs, through a mechanism that allows the moving of at least one shelf of the said cabinet.

BACKGROUND

Usually, the arrangement of the shelves on a piece of refrigeration appliances is predefined at the factory, that is, the usability of the refrigerator is limited by a previously established configuration by the manufacturer. In many domestic refrigerators and/or freezers, only the removal of shelves is permitted in order to allow the placement of foods or items of larger dimensions.

The said limitation prevents the optimization of the internal space of the said cabinet, in such a manner that the user is prevented from placing a desired quantity of items in the refrigerator or he is forced to put them in a disorganized manner often stacked randomly.

Keeping in view the abovementioned problems, various mechanisms have been developed so as to allow the moving/placing of shelves inside the refrigerator's cabinet in such a manner as to provide greater flexibility and usability.

For example, the North American document US 2004/0195945 relates to a refrigerator that has one shelf which may be associated to the internal walls of its cabinet by means of a supporting arm in a "Z" shape and which is able to move in a rotational manner, pivoting around an axis. The said supporting arm comprises a first pin mounted in an articulated manner into a hole that is positioned parallel to a second pin fitted to the shelf, wherein both pins are interlinked by an intermediate section. In its rotating movement of the supporting arm, the pins remain parallel to each other, whilst the intermediate section tilts, moving in angular manner. Although the concept of a configuration that provides vertical displacement of a shelf without tilting it is shown in this document, the need for making holes inside the cabinet represents a disadvantage, as it is necessary to make a permanent change to the internal structure of the cabinet, which requires a new specific project for this application. Besides, the supporting structure of the configuration described in this document is, apparently, not robust and resistant at all, since all the weight of the shelves as well as the items placed on it is only supported by the pins. In this way, if any mechanical stresses are applied on the structure the said pins may break, causing the shelf to fall.

The Japanese document JP 2003176977 describes a refrigerator shelf supported by a mobile structure in an "X" shape. Both arms of this structure are able to move angularly in opposite directions, so as to raise or lower the shelf that is supported at the upper ends of the said arms. The arms also comprise pins that fit into holes within the refrigerator's cabinet, thus allowing the shelves to be associated to the cabinet through its movable "X" structure. Again, besides the fact that this Japanese document shows a configuration that provides vertical displacement of a shelf without it tilting, there is still the need to make holes inside the refrigerator's cabinet. Additionally, this "X" structure configuration as described in this state of the art document is supported only by the pins, which makes it weak and with little resistance when applying greater mechanical stresses to the shelf.

The North American document U.S. Pat. No. 4,528,825 describes a movable shelf that may be moved angularly and stabilized at two vertical positions inside the refrigerator's cabinet. This movement is allowed by means of bars mounted on the movable shelf and onto a support, which on its turn is associated to a fixed upper shelf. Although this document shows a configuration that provides vertical displacement of a shelf without causing it to tilt, when the movable shelf is at the top position, it is not possible to place any item or food on it, due to the hindrance caused by the presence of the top shelf. In this way, the movable shelf may be used without the need to tilt it, but only in its bottom position, representing a usability disadvantage.

International document WO 2006/122913 relates to a shelf that is able to be stabilized at two positions: top and bottom, by means of a structure made up of two supporting elements installed on the internal side walls of the refrigerator's cabinet. The shelf has a first and second movable section that is movable between each other. The first section is also movable in relation to the supporting elements by means of pins. The second section comprises sliders that slide over guides that are comprised by the support elements. Due to the construction arrangement of the unit formed by the shelf and by the supporting elements, an tilting of the shelf occurs when it is being moved from its bottom position to the top position, which may cause items placed on it to fall. Besides, the mechanism described in this document apparently presents a constructive complexity and consequently, it is difficult to manufacture and implement it, adding a higher final cost.

Finally, the document WO 2005/001352 describes a movable shelf that may be moved from a bottom position to an upper position by means of internal guides of side supports installed inside the refrigeration cabinet. The constructive configuration shown in this document also allows the shelf to be tilted when it is being moved from a bottom to an upper position or vice-versa.

Therefore, there is still no known satisfactory and efficient solution that allows the optimization of internal space of the cabinet of a refrigeration appliance, and which presents low cost, reliability, performance and usability.

OBJECTIVES OF THE INVENTION

The first objective of the present invention consists of providing a low cost mechanism that is able to allow movement/displacement of a shelf inside a refrigeration appliance's cabinet through a solution that will not allow the said shelf to tilt, and which will still allow the implementation of simple maintenance, besides flexibility and ease of use.

The second objective of the present invention consists of providing a refrigeration appliance that is able to allow the better usage of the internal space of its cabinet according to the user's needs.

SUMMARY

The first objective of the present invention is achieved by providing a mechanism to move the shelf of a refrigeration appliance that comprises at least one refrigeratable cabinet provided with a base and two side walls disposed substantially perpendicular to the base. The side walls are substantially parallel and opposite to each other. The said shelf is disposed substantially parallel to the base. The mechanism comprises at least one supporting device associated to the refrigeratable cabinet's side wall by means of a side bar. The said side bar has a longitudinal portion that is parallel to the base, wherein the association between the supporting device and the side bar is able to provide mechanical support to the shelf. The mechanism also comprises a pivoting arm which associates the shelf to the supporting device. The said pivoting arm is provided with at least a first end connected to the shelf and a second end connected to the supporting device. The referred pivoting arm is able to move at angularly so as to displace the shelf in relation to the supporting device, wherein the angular movement of the pivoting arm in a first direction is able to allow the displacement of the shelf from an upper position to a bottom position, and, the angular movement of the pivoting arm in a second direction, that is opposite to the first direction, is able to allow the displacement of the shelf from the bottom position to an upper position.

The second objective of the present invention is achieved by providing a refrigeration appliance that comprises at least one refrigeratable cabinet provided with one base and two side walls that are disposed substantially perpendicular to the base. The said side walls are substantially parallel and opposite to each other. The said shelf is disposed substantially perpendicular to the base. The mechanism comprises at least one supporting device associated to the refrigeratable cabinet's side wall by means of a side bar. The said side bar has a longitudinal portion that is disposed substantially parallel to the base, wherein the association between the supporting device and the side bar is able to provide a mechanical support to the shelf. The mechanism also comprises a pivoting arm that associates the shelf to the supporting device. The said pivoting arm is provided with at least a first end connected to the shelf and a second end connected to the supporting device. The referred pivoting arm is able to move angularly so as to displace the shelf in relation to the supporting device, wherein the angular movement of the pivoting arm in the first direction is able to allow the displacement of the shelf from an upper position to a bottom position, and, the angular movement of the pivoting arm in a second direction, that is opposite to the first direction, is able to allow the displacement of the shelf from a bottom position to an upper position.

BRIEF DESCRIPTION OF THE DRAWINGS

The present invention will be described next in greater details with reference to the attached drawings, in which.

DETAILED DESCRIPTION OF ILLUSTRATIVE EMBODIMENTS

Figure 1:
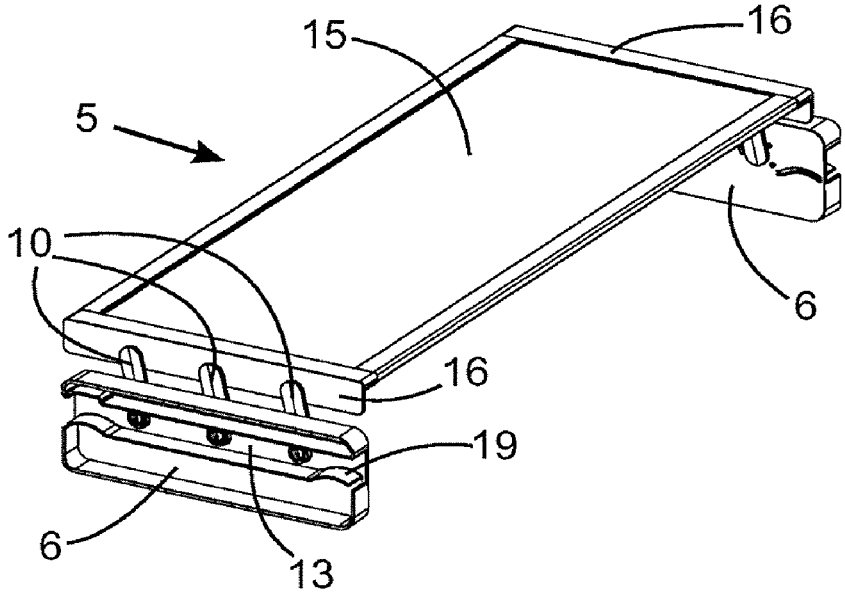
FIG. 1 shows a view in perspective of a mechanism for moving shelves of a refrigeration appliance, object of this invention, under the condition that the shelf is positioned in an upper position, and the supporting devices are disassociated from the side bars.

FIG. 1 shows a view in perspective of a mechanism for moving a shelf 5 of a refrigeration appliance 1 in accordance to a preferred embodiment of the present invention. The said refrigeration appliance 1, as shown in FIG. 11, consists preferably but not mandatory of a domestic/commercial refrigerator or freezer.

The refrigeration appliance 1 comprises at least one refrigeratable cabinet 2 provided with at least a base 3 and two side walls 4 that are substantially perpendicular to the base 3. The side walls 4 are substantially parallel and opposite to each other. The shelf 5 is placed substantially parallel to the base 3, so as to allow the stable holding of food and items that may be refrigerated. Preferably, the shelf 5 comprises an encapsulated piece of glass 15 associated to two side supporting elements 16. Alternatively, other types of shelves 5 may be used, either encapsulated or not, made up of materials such as plastics in general.

Figure 4:
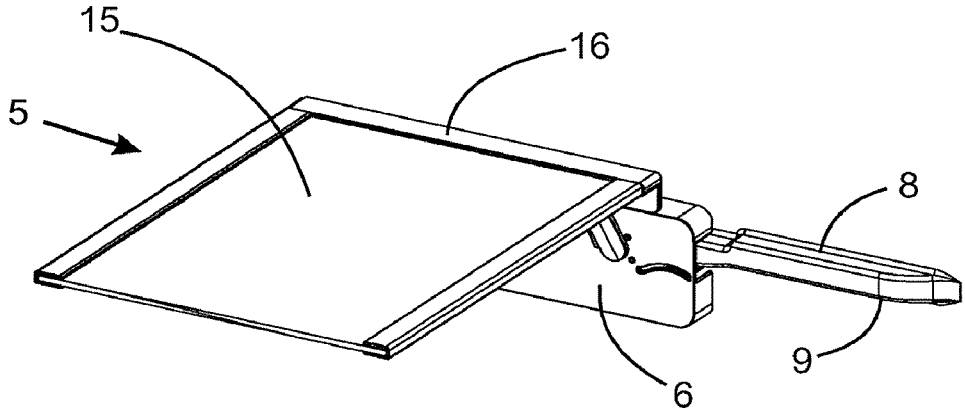
FIG. 4 shows a partial view in perspective of the mechanism shown in FIG. 1, under the condition that the shelf is positioned at the top position and the supporting device is associated to the side bar.
Figure 5:
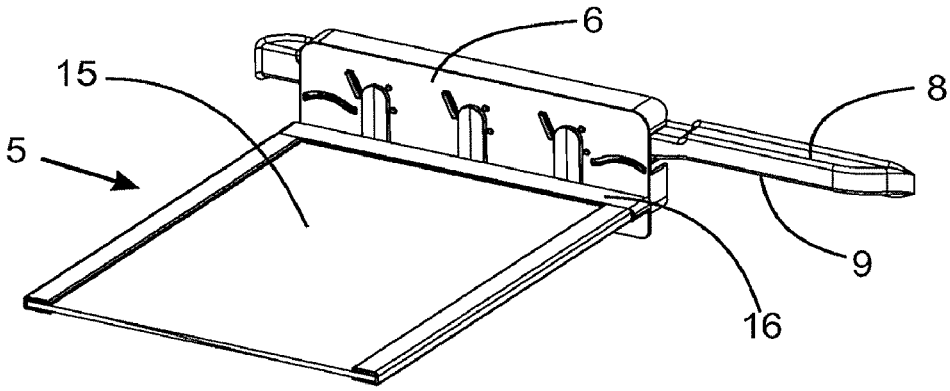
FIG. 5 shows a partial view in perspective of the mechanism shown in FIG. 1, under the condition that the shelf is positioned at the bottom position and the supporting device is associated to the side bar.
Figure 6:
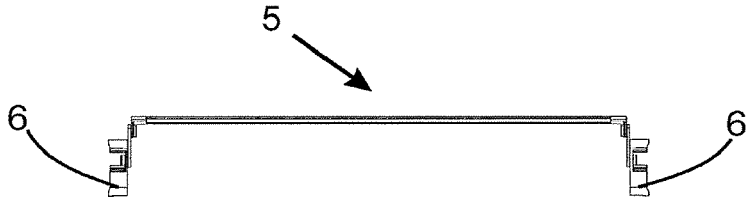
FIG. 6 shows a frontal view of the mechanism under the condition as shown in FIG. 1.
Figure 7:
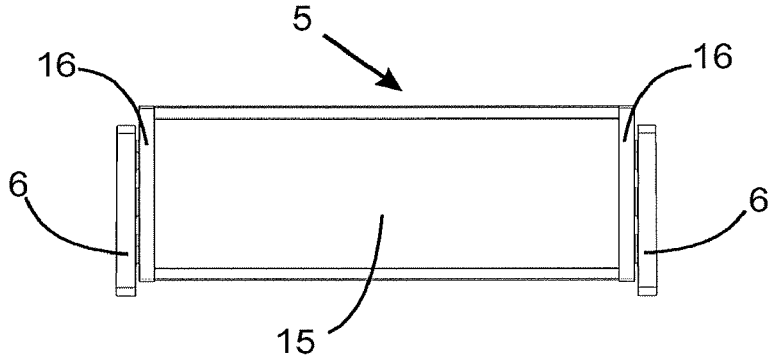
FIG. 7 shows a top view of the mechanism under the condition as shown in FIG. 1.
Figure 8:
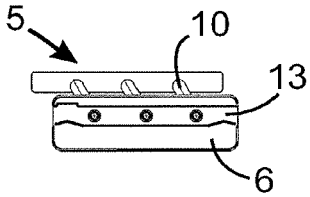
FIG. 8 shows a side view of the mechanism under the condition as shown in FIG. 1.
Figure 9:
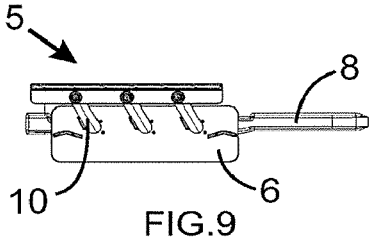
FIG. 9 shows a side view of the mechanism under the condition as shown in FIG. 4.
Figure 11:
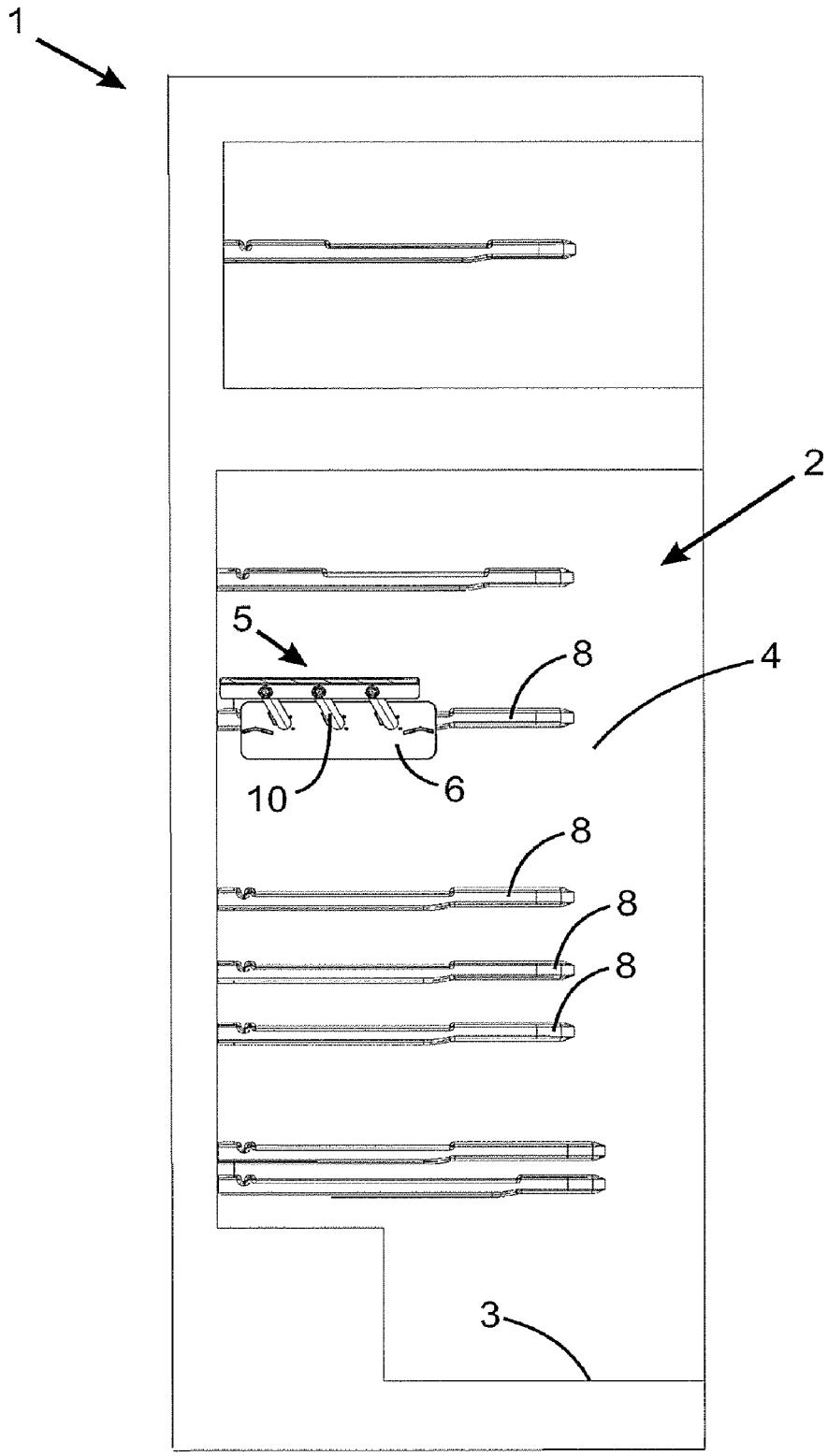
FIG. 11 shows a side view of the inside of a refrigeration appliance, also object of this invention, which comprises the mechanism as shown under the condition in FIG. 4.
Figure 12:
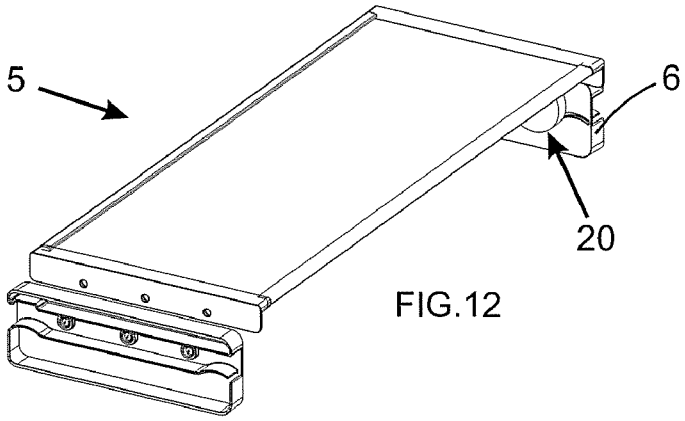
FIG. 12 shows a perspective view of the mechanism as shown in FIG. 1 comprising a levering device, under the condition that the shelf is positioned at the top position.

As shown in FIGS. 4, 5 and 11, the mechanism comprises at least one supporting device 6 associated to the side wall 4 of the refrigeratable cabinet 2 by means of a side bar 8, in such a manner that the side bar 8 extends at least over a section of the side wall's 4 width. The supporting device 6 is preferably but not mandatory manufactured of ABS plastic.

The said side bar 8, preferably but not mandatory manufactured of polystyrene plastic, is oblong and has a longitudinal portion 9 that is substantially parallel to the base 3. The side bars 8 are preferably thermoformed, providing lower cost in relation to injected parts.

Figure 2:
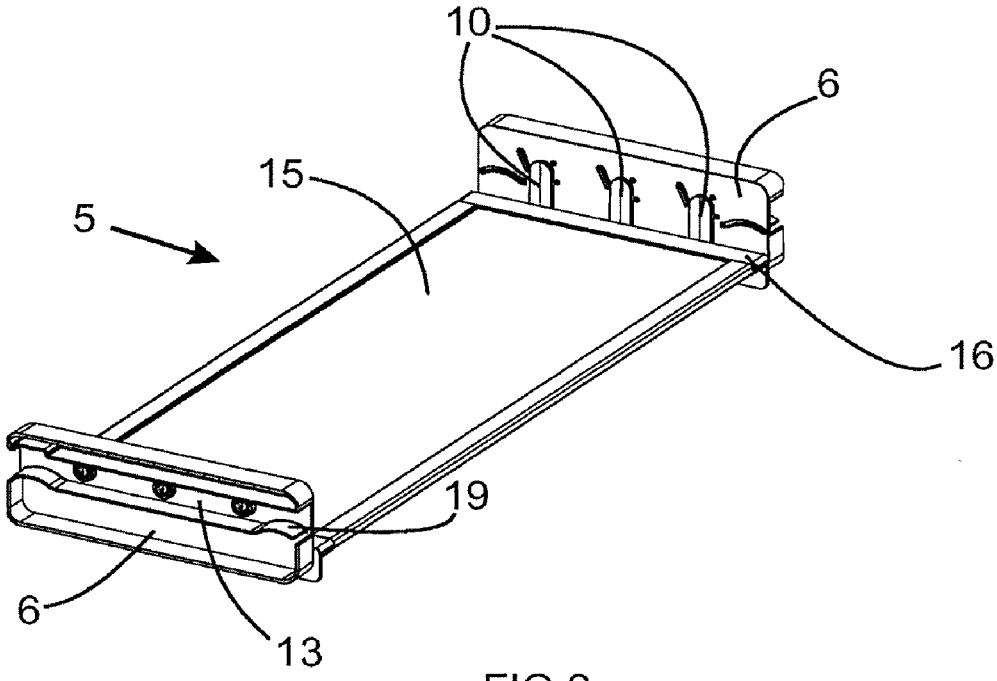
FIG. 2 shows a view in perspective of the mechanism shown in FIG. 1, under a condition that the shelf is positioned at a bottom position, and the supporting devices are disassociated from the side bars.
Figure 3:
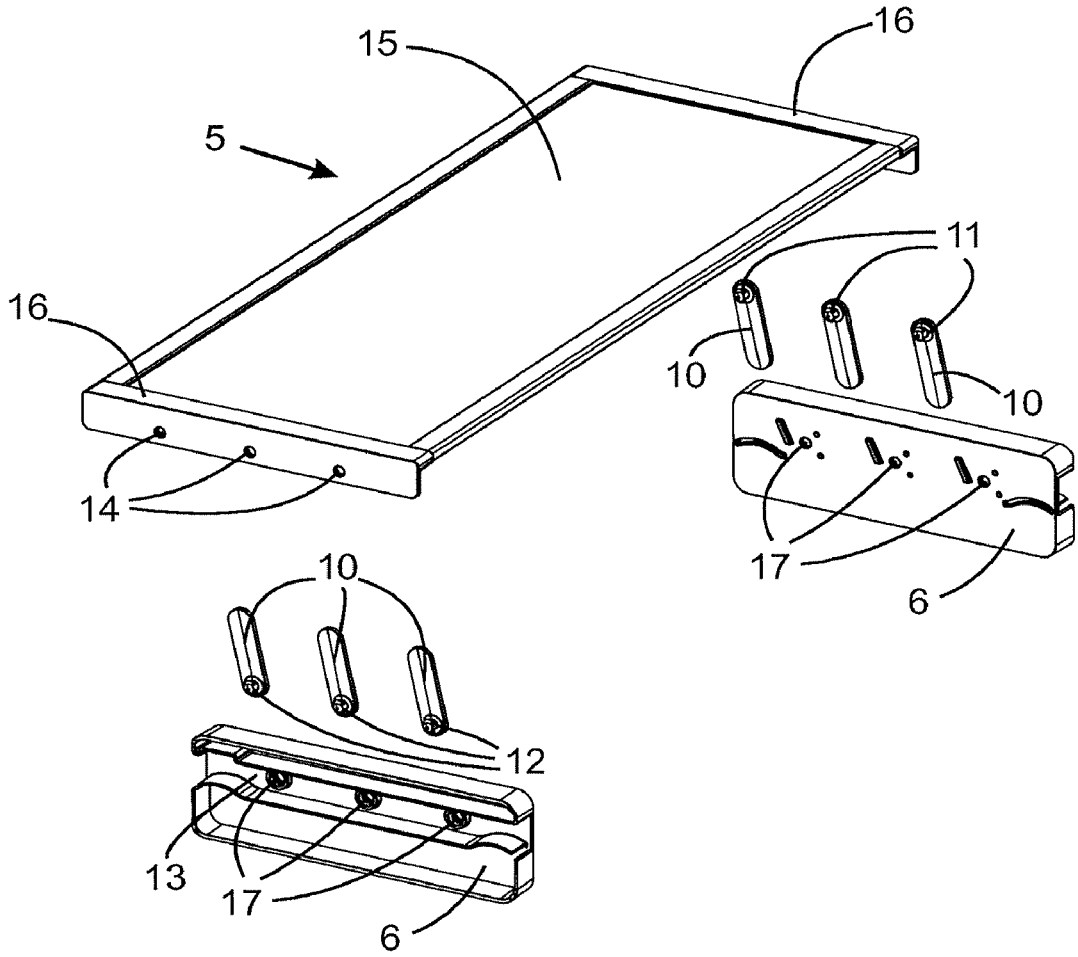
FIG. 3 shows an exploded view of the mechanism shown in FIG. 1.

As shown by FIGS. 1 to 3, the supporting device 6 also comprises a fitting cavity 13 which allows the fitting of the side bar 8 through interference. Optionally, other types of mechanical associations may be used, such as fastening it by means of screws, rivets or resins.

The supporting device 6 also comprises at least an elastic element 19, associated to the side bar 8, which is able (capable) to be compressed and provides more secure and stable locking of the supporting device 6 with the side bar 8.

The association between the supporting device 6 and the side bar 8 is able to provide a mechanical support to the shelf 5, so as to guarantee safety and stability of the mechanism as well as the food and refrigerated items placed on top of the shelf 5. Contrary to the mechanisms shown by documents US 2004/0195945 and JP 2003176977, in which sustentation is provided only by pins, this invention provides a robust structure formed by supporting device 6 and side bar 8, which provides more reliability and resistance to heavier loads.

Preferably, the shelf 5 is associated to two side bars 8 that are placed opposite to each other (each side bar 8 is associated to a side wall 4).

Thus, both side bars 8 are disposed in a geometric plan that is substantially parallel to the base 3, so as to guarantee that the shelf 5 remains parallel in relation to the base 3.

Still preferably, the side bar 8 is integrated in a single piece to the refrigeratable cabinet 2. As shown by FIG. 11, the refrigeration appliance 1 comprises a number of side bars 8 that may be used to support other types of shelves and/or structures and mechanisms to move shelves. Therefore, side bar 8 is of a multiuse type, and in this manner, it is not necessary to manufacture a specific sidebar for the mechanism of this invention, thus providing reduction in costs and flexibility to the user. Alternatively, side bar 8 may be associated to the refrigeratable cabinet 2 by mechanical means, a suitable resin that may be applied or even fitted so that it can be removed.

The mechanism also comprises a pivoting arm 10, which associates the shelf 5 to the supporting device 6. The pivoting arm 10 is fitted on at least one first end 11 which is connected in an articulate manner to the shelf 5 and at least one second end 12 which is also connected in an articulate manner to the supporting device 6.

The first end 11 of pivoting arm 10 is associated to the shelf 5 by means of a removable fitting through interference. The said fitting is allowed by a first hole 14 comprised by the shelf 5. Preferably, the shelf 5 comprises a number of first holes 14 so as to allow the fitting of a plurality of pivoting arms 10. In the constructive configuration as shown by FIG. 3, the first holes 1 are comprised by the side supporting element 16 of the shelf 5.

The second end 12 of the pivoting arm 10 is associated to the supporting device 6 by means of a removable fitting through interference. The said fitting is permissible through a second hole 17 comprised by the supporting device 6. Preferably, the supporting device 6 comprises a number of second holes 17, so as to allow for the fitting of a plurality of pivoting arms 10.

The pivoting arm 10 is able to move angularly so as to allow the movement of the shelf 5 in relation to the supporting device 6. Particularly, the first end 11 moves in a rotational manner in relation to the shelf 5 through the first hole 14. Similarly, the second end 12 moves rotationally in relation to the supporting device 6 through the second hole 17. The angular movement of the first end 11 and the second end 12 occurs concomitantly.

Figure 10:
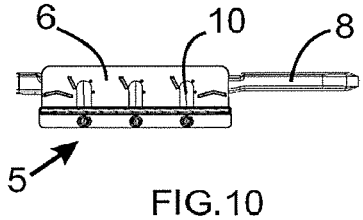
FIG. 10 shows a side view of the mechanism under the condition as shown in FIG. 5.

In this manner, the angular movement of the pivoting arm 10 allows the shelf 5 to be displaced from an upper position to a bottom position and vice-versa. Preferentially, the upper and bottom positions respectively represent the maximum and minimum vertical limits that the shelf 5 may achieve, as shown by FIGS. 1, 4, 6, 7, 8 and 9 (maximum limit) and FIGS. 2, 5 and 10 (minimum limit) Optionally, the shelf 5 may also occupy intermediate positions (stable) between the maximum and minimum vertical limits Thus, the angular movement of the pivoting arm 10 in a first direction is able to allow the shelf 5 to be displaced from an upper position to a bottom position. On the other hand, the angular movement of the pivoting arm 10 in a second direction, opposite to the first direction, is able to allow the displacement of the shelf 5 from the bottom position to the upper position.

Preferentially, the mechanism comprises six pivoting arms 10, distributed 3 by 3 that are symmetrically opposed in relation to the shelf 5, as shown in FIGS. 1 to 3. Evidently, another suitable number of pivoting arms 10 may be implemented. This constructive layout allows that throughout the entire movement of pivoting arm 10, the shelf 5 will always remain in the same horizontal position, substantially parallel to the base 3, so as to maintain the foods and items that are refrigerated in a stable manner on the shelf 5.

Thus, this constructive configuration never allows the shelf 5 to tilt during its angular movement, that is, the shelf 5 will always maintain its stable horizontal position, whilst it is being displaced from its upper position to the bottom position. Therefore, this constructive configuration prevents that the items placed on the shelf fall over or off, thus providing greater security.

Besides, the mechanism also presents simplified cleaning/maintenance and implementation as the associations between the pivoting arms 10, the side bars 8, the supporting devices 6 and the shelves 5 may be carried out in a removable manner, through the fittings through interference, dispensing the use of special tools and more specific technical knowledge.

The angular movement of the pivoting arm 10 is provided by a manual force that is applied by the user or by a mechanical force that is applied at least an electrical motor (not shown in the Figures) associated to the referred pivoting arm 10. In this last mentioned case, the electrical motor is provided with an axle that is associated to the second end 12 of the pivoting arm 10, so that the transmission of the torque through rotation may be applied to the said pivoting arm 10. The electrical motor may be activated by the user through a button mounted on the refrigeration appliance 1, allowing greater ease of use.

Optionally, the mechanism of this invention comprises at least one levering device 20 operatively associated to the pivoting arm 10. The said levering device 20, as shown on FIGS. 12 to 17, operates in a similar manner as a "push to open" type of mechanism specifically adapted for this application. As a general rule, the user must apply a force to the shelf 5 in the opposite direction in which the displacement of shelf 5 is desired, so that an elastic element 25 is activated in order to provide the necessary said impulse that is needed for its displacement.

Preferably, the levering device 20 provides the raising movement of the shelf 5, that is, the displacement of the shelf 5 from the bottom position to the upper position. Nevertheless, the levering device 20 may also provide the lowering movement of the shelf 5, that is, the displacement of the shelf 5 from the upper position to the bottom position. In an alternative embodiment, the mechanism may comprise a plurality of levering devices 20 that operate in an interspaced manner, to provide both the lowering as well as the raising movement for the shelf 5.

Thus, the levering device 20 is able to be manually moved in a first angular direction so as to allow the displacement of the shelf 5 from the upper position to the bottom position by moving the pivoting arm 10, also in the first direction, as has already been described previously.

On the other hand, the levering device 20 is able to be moved manually in a second angular direction, opposite to the first direction, so as to allow the displacement of the shelf 5 from the bottom position to the upper position by moving the pivoting arm 10, also in the second direction, as has already been previously described.

Figure 17:
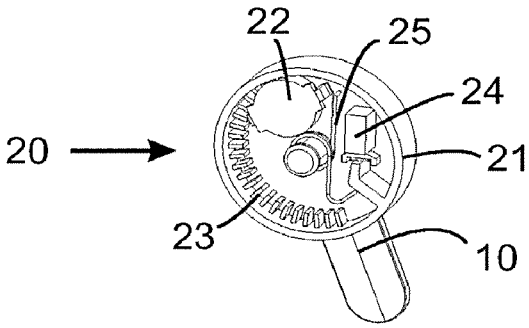
FIG. 17 shows a perspective view of the levering device as shown in FIG. 12, showing its internal elements.

As can be seen in FIG. 17, the levering device 20 comprises an internal toothed gear 23 operatively associated to a braking element 22 that is able to provide a controlled angular movement of the levering device 20, in such a manner as to prevent that the refrigerated items as well as the foods that are placed on the shelf 5 do not fall over or off. Thus, the braking element 22 drags itself over the internal toothed gear 23 during the pivoting arm 10 movement.

The braking element 22 is operatively associated to a locking element 24 by means of an elastic element 25 that is able (capable) to be compressed when the angular movement of the levering device 20 in the first direction (lowering of the shelf 5) and is able to be decompressed during the angular movement of the levering device 20 in the second direction (raising of the shelf 5). Preferentially, the braking element 22 consists of a viscous brake. The locking element 24 is able to establish an extreme limit of the levering device 20. Still preferably, but not mandatory, the locking element 24 consists of a lock and the elastic element 25 consists of a spring.

On the other hand, the elastic element 25 is able to decompress when the levering device 20 moves in an angular motion in the first direction (lowering of the shelf 5) and it is able to compress when the levering device's 20 angular movement is in the opposite direction (raising of the shelf 5).

The internal toothed gear 23 and the braking element 22 as well as the locking element 24 and the elastic element 25 are enclosed in a housing 21 that has a circular format.

Figure 13:
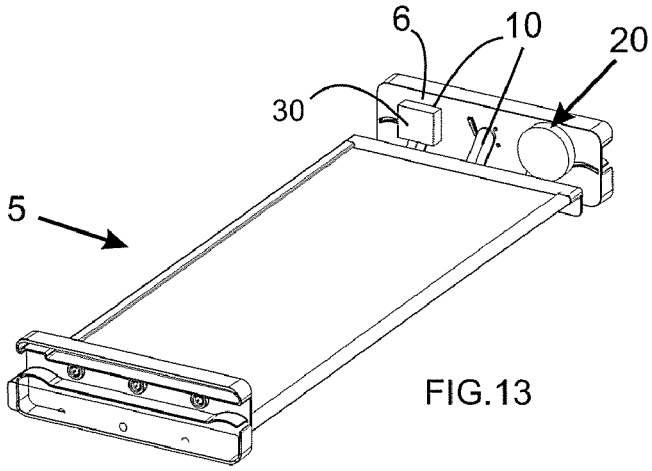
FIG. 13 shows a perspective view of the mechanism as shown in FIG. 12, under the condition that the shelf is positioned at the bottom position.
Figure 14:
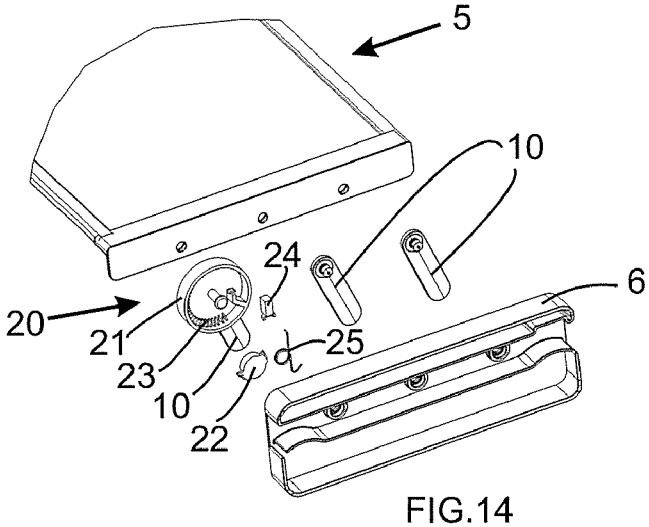
FIG. 14 shows a partial exploded view in perspective of the mechanism as shown in FIG. 12.
Figure 15:
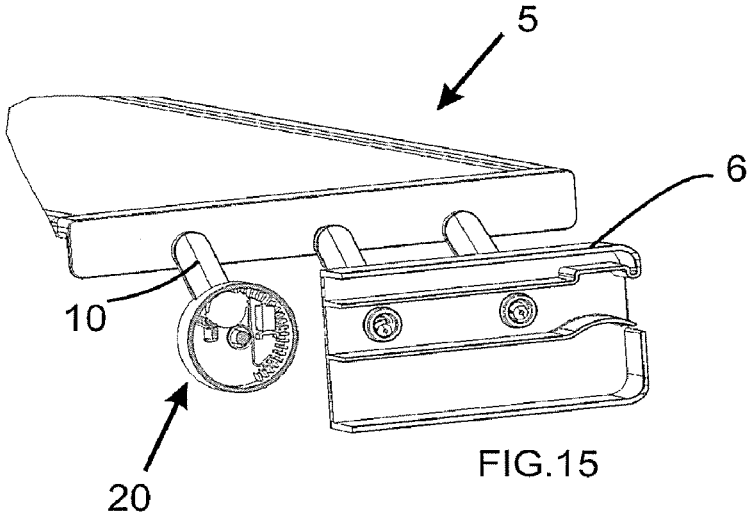
FIG. 15 shows a partial view in perspective of the mechanism as shown in FIG. 12.
Figure 16:
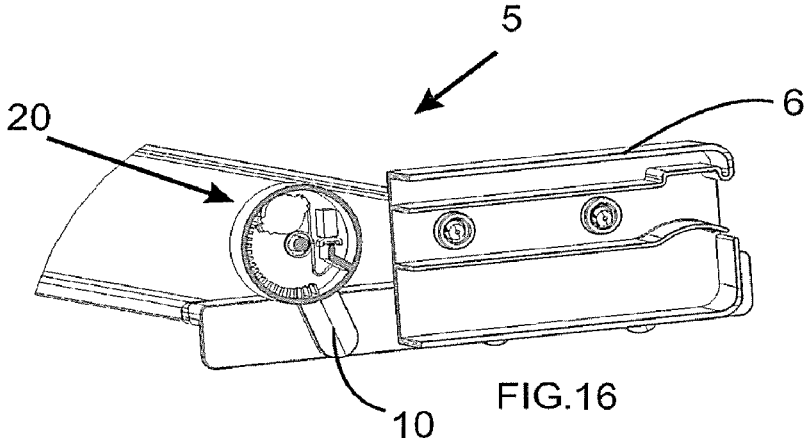
FIG. 16 shows a partial view in perspective of the mechanism as shown in FIG. 12, under the condition that the shelf is positioned at the bottom position.

Additionally, FIG. 13 shows an example of possible connections of the levering device 20 and the electric motor 30. As previously stated, the electrical motor 30 is provided with an axle that is associated to the second end 12 of the pivoting arm 10.

After describing an example of a preferred embodiment, it shall be understood that the scope of the present invention comprises other possible variations, being limited only by the contents of the attached claims, where the possible equivalents are included.

What is claimed:

1. A mechanism for moving shelves of a refrigeration appliance, the-refrigeration appliance comprising a refrigeratable cabinet provided with at least one base and two side walls that are disposed substantially perpendicular to the base, the side walls being substantially parallel and opposite to each other, and the mechanism comprising at least:

one supporting device associated to one of the side walls of the refrigeratable cabinet by means of a side bar, the side bar having a longitudinal portion that is substantially parallel to the base, wherein the association between the supporting device and the side bar is able to provide a mechanical support to a shelf being disposed substantially parallel to the base; and a pivoting arm that associates the shelf to the supporting device, the pivoting arm being provided with at least a first end connected articulatedly to the shelf, wherein the first end is removably fitted to the shelf through interference, and a second end connected articulatedly to the supporting device, the pivoting arm being able to move angularly so as to allow the shelf to be moved in relation to the supporting device, wherein the angular movement of the pivoting arm in the first direction is able to allow the shelf to be displaced from an upper position to a bottom position, and, the angular movement of the pivoting arm in a second direction, opposite to the first direction, is able to allow the displacement of the shelf from the bottom position to the upper position at least one electrical motor associated to the pivoting arm, the electrical motor being able to provide the angular movement of the pivoting arm, at least one levering device operatively associated to the pivoting arm, the levering device being manually operable, the levering device being able to be moved in a first angular direction so as to allow the displacement of the shelf from the upper position to the bottom position, the levering device being able to be moved in a second angular direction, opposite the first direction, so as to allow the displacement of the shelf from the bottom position to the upper position, wherein the levering device comprises an internal toothed gear operatively associated to a braking element, the braking element being able to provide a controlled speed to the angular movement of the levering device, wherein the braking element is operatively associated to a locking element by means of an elastic element, the elastic element being able to either compress or decompress during the angular movement of the levering device in the first direction, and the elastic element being able to either decompress or compress during the angular movement of the levering device in the second direction, the locking element being able to establish an extreme limit of movement of the levering device.

2. The mechanism of claim 1, wherein the electric motor is fitted with an axis that associates with the second end of the pivoting arm.

3. The mechanism of claim 1, wherein the second end of the pivoting arm is removably fitted to the supporting device through interference.

4. The mechanism of claim 1, wherein the supporting device comprises a fitting cavity which allows the fitting of the side bar through interference.

5. The mechanism of claim 1, wherein the supporting device comprises at least one elastic element associable to the side bar, the elastic element being able to provide locking between the supporting device and the side bar.

6. The mechanism of claim 1, wherein the shelf is associated to two side bars, each side bar being associated to each side wall, both side bars being disposed on a geometric plane that is substantially parallel to the base.

7. The mechanism of claim 1, wherein the shelf comprises at least a first hole able to allow the fitting of the first end of the pivoting arm.

8. The mechanism of claim 7, wherein the shelf comprises a plurality of first holes.

9. The mechanism of claim 1, wherein the supporting device comprises at least a second hole able to allow the fitting of the second end of the pivoting arm.

10. The mechanism of claim 9, wherein the supporting device comprises a plurality of second holes.

11. The mechanism of claim 7, wherein the shelf comprises an encapsulated piece of glass associated to two side supporting elements, both side supporting elements having a plurality of first holes.

12. The mechanism of claim 1, wherein the elastic element being able to compress during the angular movement of the levering device in the first direction, and the elastic element being able to decompress during the angular movement of the levering device in the second direction.

13. The mechanism of claim 1, wherein the elastic element being able to decompress during the angular movement of the levering device in the first direction, the elastic element being able to compress during the angular movement of the levering device in the second direction.

14. The mechanism of claim 1, further comprising a plurality of levering devices.

15. The mechanism of claim 1, wherein the braking element consists of a viscous brake.

16. The mechanism of claim 1, wherein the locking element consists of a lock.

17. The mechanism of claim 1, wherein the elastic element consists of a spring.

18. A refrigeration appliance comprising a refrigeratable cabinet provided with a base and two side walls disposed substantially perpendicularly to the base, the side walls being substantially parallel and opposite to each other, the side walls being associated to a shelf, the shelf being disposed substantially parallel to the base, the refrigeration appliance comprising:

a supporting device associated to one of the side walls of the refrigeratable cabinet by means of a side bar, the side bar having a longitudinal portion that is substantially parallel to the base, wherein the association between the supporting device and the side bar is able to provide mechanical support to the shelf; and a pivoting arm that associates the shelf to the supporting device, the pivoting arm being provided with at least a first end connected articulatedly to the shelf wherein the first end is removably fitted to the shelf through interference, and a second end connected articulatedly to the supporting device, the pivoting arm being able to move angularly so as to allow the movement of the shelf in relation to the supporting device, wherein the angular movement of the pivoting arm in the first direction is able to allow the displacement of the shelf from an upper position to a bottom position, and, the angular movement of the pivoting arm in a second direction, opposite to the first direction, is able to allow the displacement of the shelf from the bottom position to the upper position at least one electrical motor associated to the pivoting arm, the electric motor being able to provide the angular movement of the pivoting arm, at least one levering device operatively associated to the pivoting arm, the levering device being manually operable, the levering device being able to be moved in a first angular direction so as to allow the displacement of the shelf from the upper position to the bottom position, the levering device being able to be moved in a second angular direction, opposite the first direction, so as to allow the displacement of the shelf from the bottom position to the upper position, wherein the levering device comprises an internal toothed gear operatively associated to a braking element, the braking element being able to provide a controlled speed to the angular movement of the levering device, wherein the braking element is operatively associated to a locking element by means of an elastic element, the elastic element being able to either compress or decompress during the angular movement of the levering device in the first direction, and the elastic element being able to either decompress or compress during the angular movement of the levering device in the second direction, the locking element being able to establish an extreme limit of movement of the levering device.

19. The refrigeration appliance of claim 18, wherein the side bar is integrated as a single piece in the refrigeratable cabinet.

* * * * *